US009841149B2

(12) United States Patent
Wu et al.

(10) Patent No.: US 9,841,149 B2
(45) Date of Patent: Dec. 12, 2017

(54) LED LAMP

(71) Applicant: UNITY OPTO TECHNOLOGY CO., LTD., New Taipei (TW)

(72) Inventors: Chih-Hsien Wu, New Taipei (TW); Po-Wen Hsiao, New Taipei (TW); Hsi-Yu Chen, New Taipei (TW); Han-Chi Chi, New Taipei (TW)

(73) Assignee: Unity Opto Technology Co., Ltd., New Taipei (TW)

( * ) Notice: Subject to any disclaimer, the term of this patent is extended or adjusted under 35 U.S.C. 154(b) by 134 days.

(21) Appl. No.: 14/985,734

(22) Filed: Dec. 31, 2015

(65) Prior Publication Data

US 2017/0102113 A1 Apr. 13, 2017

(30) Foreign Application Priority Data

Oct. 8, 2015 (TW) ..... 104216193 U

(51) Int. Cl.

| | |
|---|---|
| ***F21S 8/06*** | (2006.01) |
| ***F21K 9/272*** | (2016.01) |
| ***F21V 23/00*** | (2015.01) |
| ***F21V 23/06*** | (2006.01) |
| ***F21V 23/04*** | (2006.01) |
| *F21Y 115/10* | (2016.01) |

(52) U.S. Cl.

CPC ..... *F21K 9/272* (2016.08); *F21S 8/06* (2013.01); *F21V 23/001* (2013.01); *F21V 23/04* (2013.01); *F21V 23/06* (2013.01); *F21Y 2115/10* (2016.08)

(58) Field of Classification Search

CPC ..... F21K 9/272; F21V 23/001; F21V 23/04; F21V 32/06; F21V 23/06; F21S 8/06; F21S 8/061; F21S 4/20; F21Y 2115/10

See application file for complete search history.

(56) References Cited

U.S. PATENT DOCUMENTS

| | | | | |
|---|---|---|---|---|
| 2,820,884 | A * | 1/1958 | Yetman | F21V 31/00 174/535 |
| 7,341,359 | B2 * | 3/2008 | Hwang | F21S 8/04 362/217.05 |
| 7,887,226 | B2 * | 2/2011 | Huang | F21K 9/27 362/225 |
| 8,616,726 | B2 * | 12/2013 | Chen | F21V 15/013 362/249.01 |
| 2015/0300585 | A1 * | 10/2015 | Wu | F21V 21/112 362/222 |
| 2015/0345765 | A1 * | 12/2015 | Horst | F21V 31/005 362/362 |
| 2016/0327252 | A1 * | 11/2016 | Ray | F21V 21/008 |

* cited by examiner

*Primary Examiner* — Peggy Neils

(74) *Attorney, Agent, or Firm* — Rosenberg, Klein & Lee

(57) ABSTRACT

Disclosed is an LED lamp having a tube and two end covers. The end covers are connected to both sides of the tube for accommodating a power supply member or a power conversion member, and the end covers have a first penetrating hole for engaging a connecting member to hang or install the LED lamp. The LED lamp further includes at least one back plate having at least two first locking holes, and each end cover has at least one second locking hole corresponsive to the first locking holes. At least two latching members pass through the first locking hole and the second locking hole to connect the back plate and the end cover and the back plate is situated on a side of the tube, so that the back plate is connected closely with the end cover and will not be separated easily by external forces or collisions.

16 Claims, 7 Drawing Sheets

LED LAMP

CROSS-REFERENCE TO RELATED APPLICATIONS

This non-provisional application claims priority under 35 U.S.C. §119(a) on Patent Application No(s). 104216193 filed in Taiwan, R.O.C. on Oct. 8, 2015, the entire contents of which are hereby incorporated by reference.

TECHNICAL FIELD

The technical field relates to LED lamps, and more particularly to the LED lamp that protects an LED tube by a back plate and provides excellent connection between the back plate and the lamp, while maximizing the utility of space.

BACKGROUND

With the advantages of high color rending and light emitting efficiency, most fixed or portable lamps available in the market adopt light emitting diode LED as light source. In general, the lamps installed to indoor ceiling are mainly divided into tube lamps, embedded lamps, ceiling lamps, etc and provided for the illumination purpose.

For example, a conventional LED tube lamp requires a fixed support frame installed to the ceiling and having a plurality of electric connecting holes, and the LED tube has an end covers installed on both sides of the Led tube separately and a plurality of pins disposed at each end cover and configured to be corresponsive to the electric connecting holes respectively. In the installation procedure of the LED tube, the LED tube is screwed and connected to the fixed support frame, and the pins are respectively and electrically connected to the electric connecting holes for driving the LED tube. However, such installation procedure is complicated and time-consuming and limited to the specification of the LED tube, since the specifications of the fixed support frame and the LED tube must be matched, and the compatibility issue causes tremendous inconvenience to users.

To overcome the inconvenience of the aforementioned detachably installed lamp, electronic components are installed in the end covers and electrically connected to the LED tube, so as to form a one-piece lamp capable of supplying electric power to the LED tube from an external power supply. As a result, the installation of the fixed support frame is no longer needed, and the efficiency of installation and the convenience of use are improved, and the LED lamp may be hanged or fixed to the ceiling without requiring the fixed support frame or the matched model. However, this method requires the electronic components for driving the lamp to be installed in the end covers, and most end covers of the conventional LED tube come with a circular cylindrical shape to facilitate their connection. Therefore, the space of the end cover available for installing the components is reduced significantly, and thus making the configuration of the components difficult. In addition, the lamps of this sort no longer require the installation of a fixed support frame to the ceiling, so that the LED lamp can be hanged or fixed to the ceiling by a connecting element for the use of the LED lamp. In general, the connecting element has an end connected to the LED lamp through a through hole of the end cover and the other end used for fixing or hanging the LED lamp to the ceiling. As described above, electronic components such as a power supply element are installed in the end covers, so that after the connecting element and the end covers are installed, the electronic components in the end covers may be in contact with the connecting element, and such contact may cause fire accidents and concerns on the stability and safety of the lamp. Alternatively, a connecting portion is formed and extended outwardly from the end cover and provided for forming a through hole, so that the end cover is in a closed device that prevents the connecting element from contacting with the electronic components. However, this method requires the design of an additional connecting portion, and thus not just increasing the manufacturing cost only, but also affecting the overall vertical height and the aesthetic appearance of the hanged LED lamp. In addition, the one-piece lamp hanged or fixed to the ceiling usually does not come with a design for protecting the surfaces of the LED tube, and the LED tube is often exposed to the outside and may be damaged easily after a long time of use.

In view of the aforementioned problems of the conventional lamps, the discloser of this disclosure developed an LED lamp with high safety and efficiency to overcome the problems of the prior art.

SUMMARY

It is a primary objective of this disclosure to provide an LED lamp that includes a back plate structure to protect the tube, and provides a good connection between the back plate and the end cover of the lamp to prevent the back plate and the end cover from being separated from each other by external force or collision during the transportation or use of the LED lamp.

Another objective of this disclosure is to provide an LED lamp capable of maximizing the utility of space and preventing the electronic components of the lamp from being in contact with other components that may cause a short circuit, so as to improve the safety of use of the lamp.

To achieve the aforementioned and other objectives, this disclosure provides an LED lamp comprising a tube and two end covers, and the tube including an LED module installed therein, and the end covers being coupled to both ends of the tube respectively and provided for accommodating a power supply member or a power conversion member, and the power supply member and the power conversion member being electrically connected to the LED module, and the end covers having a first penetrating hole for installing a connecting member to hang or install the LED lamp, and the LED lamp being characterized in that the LED lamp further comprises a back plate, having at least two first locking holes, and each end cover has at least one second locking hole corresponsive to the first locking holes, and at least two latching members pass through the first locking hole and the second locking hole, so that the back plate and the two end covers are coupled to one another and engaged to a side of the tube; each end cover is a rectangular structure having an accommodating space, and the accommodating space has an isolating plate, for isolating the power supply member or the power conversion member, and contacting the connecting member through the first penetrating hole.

With the structural design of the first locking hole and the second locking hole together with the latching member, the connection strength and rigidity between the back plate and the end covers are enhanced to prevent the assembled components from being loosened or separated by external forces during a transportation process and improve the safety of use when the lamp is hanged or installed. In the meantime, the rectangular end cover further increases the volumetric efficiency and the isolating plate further prevents short circuits or fire accidents.

Wherein, the back plate has at least two engaging portions, and each engaging portion is formed by extending outwardly from a side of the back plate and has a first recess, and each first locking hole is disposed in the first recess, and each end cover has a second recess corresponsive to the first recess, and the second locking hole is disposed in the second recess. With the first recess and the second recess, the latching member may be locked to the back plate and the end cover without protruding out from the back plate, so as to achieve the effect of protecting the latching member. In the meantime, after the first recess and the second recess are superimposed, the first locking hole and the second locking hole are aligned precisely with each other to achieve the aligning effect and simplify the process of connecting the back plate and the end cover.

To protect the latching member and prevent it from displacing after it is locked to the back plate and the end cover, each end cover has an accommodating slot formed on an inner side of the end cover and configured to be corresponsive to the second recess and the second locking hole, so that after the latching member is locked to the back plate and the end cover, the latching member is situated in the accommodating slot.

In addition, each end cover has an upper casing and a lower casing disposed opposite to each other and assembled to form the end cover, and the second recess and the second locking hole are disposed on the upper casing, so that the back plate is disposed on a backlit side of the tube.

To fix the isolating plate in position, each end cover has a plurality of first fixing portions disposed on an inner side of the end cover, and the isolating plate has a plurality of second fixing portions configured to be corresponsive to the first fixing portions and fixed to the first fixing portions respectively. Preferably, each of the first fixing portions is a recess or a bump, and each of the second fixing portions is a bump or a recess corresponsive to the respective first fixing portion. The isolating plate is fixed into the accommodating space by a latching method.

In addition, any one of the end covers of the LED lamp has an electric wire and a plug, and the plug is electrically coupled to the power supply member through the electric wire, and any one of the end covers has a socket electrically coupled to the power conversion member. With the installation of the plug and the socket, the LED lamp may be normally and electrically connected to an external power supply, and the socket may be connected to other electronic devices, such that the LED lamp can be used as a power supply, or the socket may be serially connected with the plugs of several LED lamps.

The LED lamp further comprises a switch installed at one of the end covers and electrically coupled to the power supply member, so that a user may control the using status of the LED lamp easily when the LED lamp is normally and electrically connected to the external power supply.

In addition, the first penetrating holes are formed on the upper casing, and one of the first penetrating holes is tapered towards a side, and another first penetrating hole is tapered towards a side or both sides to engage the connecting member, so that the connecting member is latched to the tapered side of the first penetrating hole to provide a diversified installation method.

To engage the tube with the end covers, each end cover has a connecting portion formed thereon, and each connecting portion being in a circular shape and having a plurality of ribs disposed on an inner side of the connecting portion, and the tube has a plurality of second through holes formed at both ends of the tube and corresponsive to the ribs and latched with the ribs respectively.

In summation of the description above, the LED lamp of this disclosure comes with the structural design of the first locking holes and the second locking holes together with the locking members to enhance the connection of the back plate and the end covers and prevent the back plate and the end covers from being separated during the transportation or use of the lamp. In the meantime, the rectangular end covers improves the utility of the accommodating space and the isolating plate prevents short circuits or fire accidents caused by the contact of electronic components with the connecting member, so as to improve the safety of use of the lamp. In addition, the structure with the first recesses, the second recesses and the accommodating slots provides a good protection to the latching member and simplifies the process of connecting the back plate and the end covers.

DESCRIPTION OF THE PREFERRED EMBODIMENTS

The above and other objects, features and advantages of this disclosure will become apparent from the following detailed description taken with the accompanying drawings.

Figure 1:
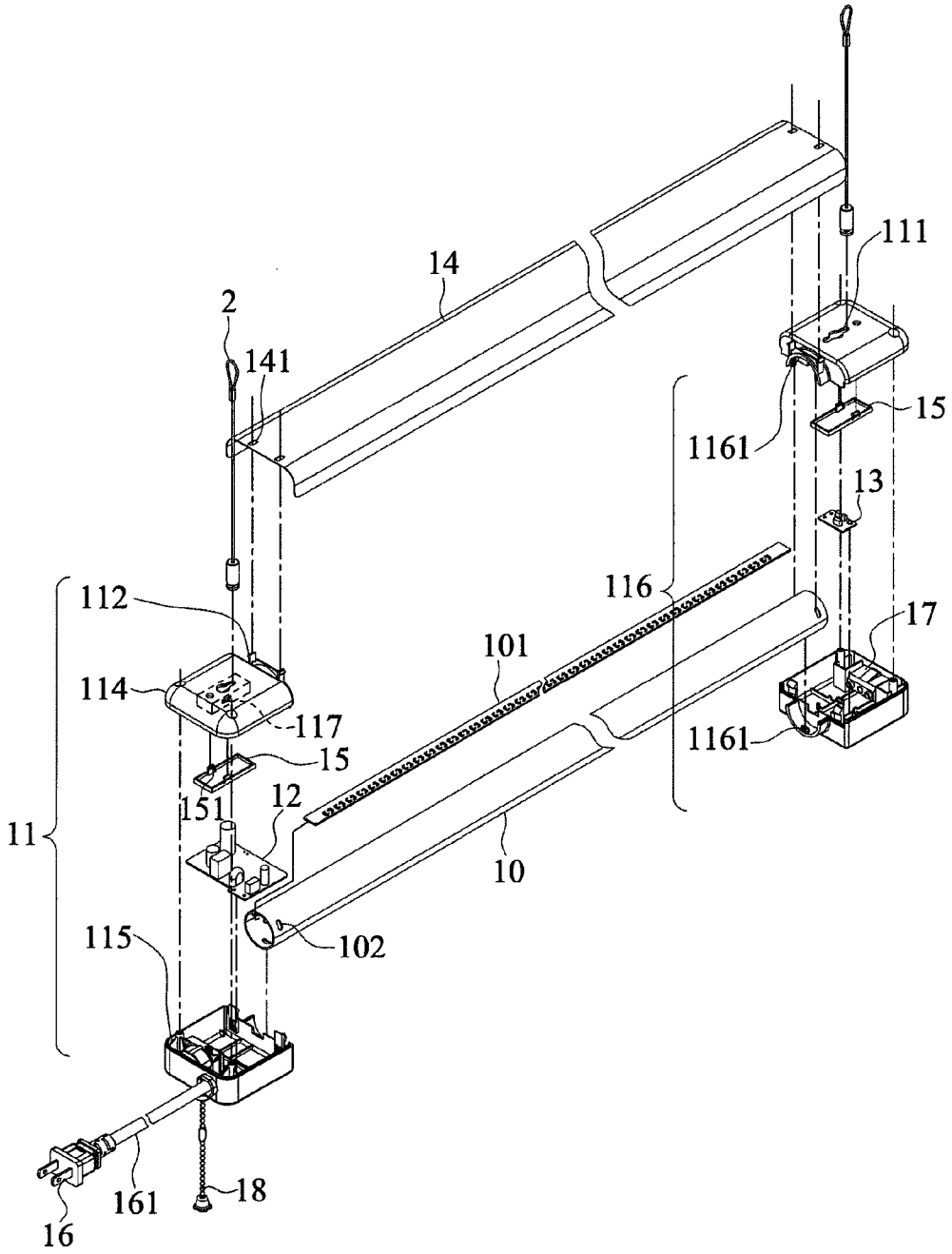
FIG. 1 is an exploded view of an experimental embodiment of this disclosure.
Figure 2:
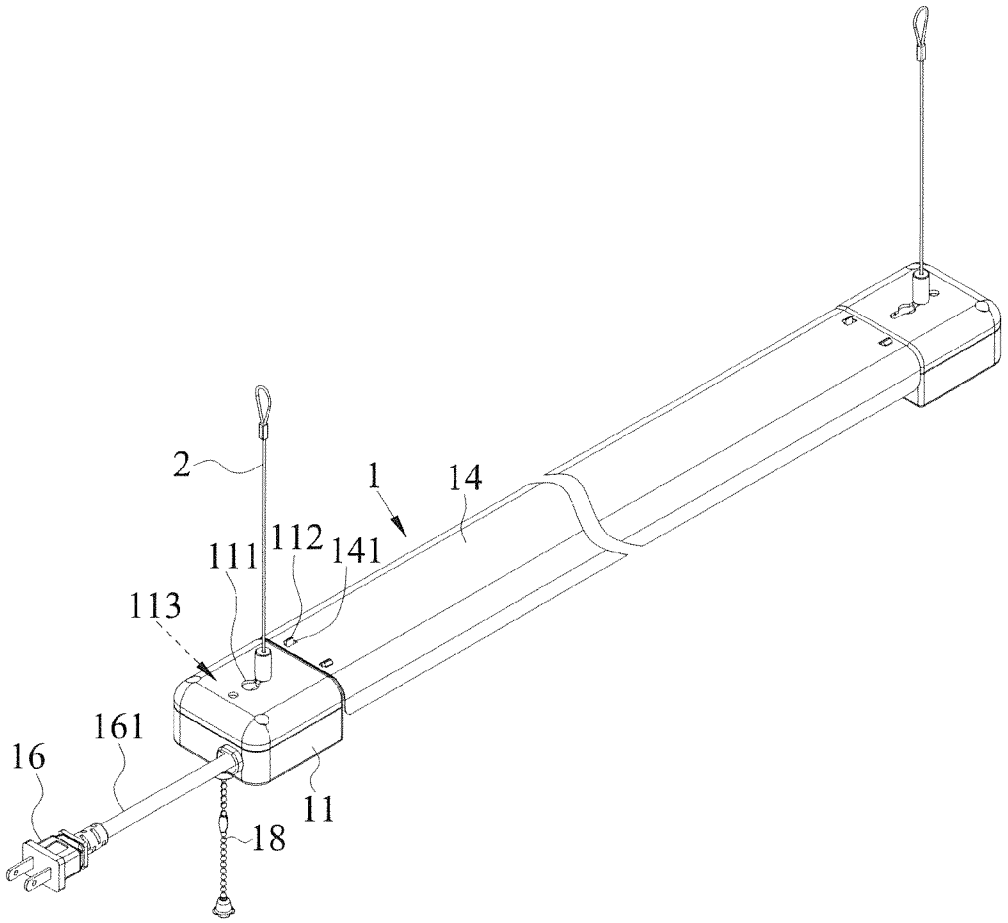
FIG. 2 is a schematic view of an assembly of an experimental embodiment of this disclosure.
Figure 3:
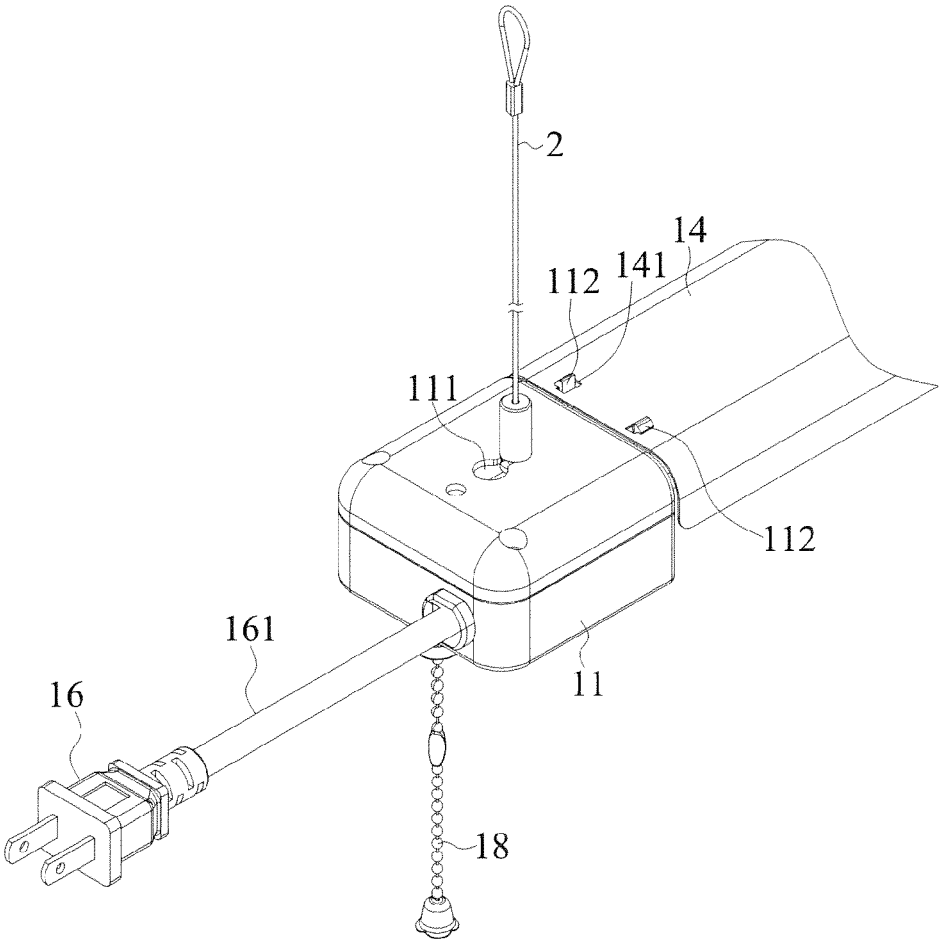
FIG. 3 is a schematic view of a partial assembly including a back plate and an end cover in accordance with an experimental embodiment of this disclosure.
Figure 4A:
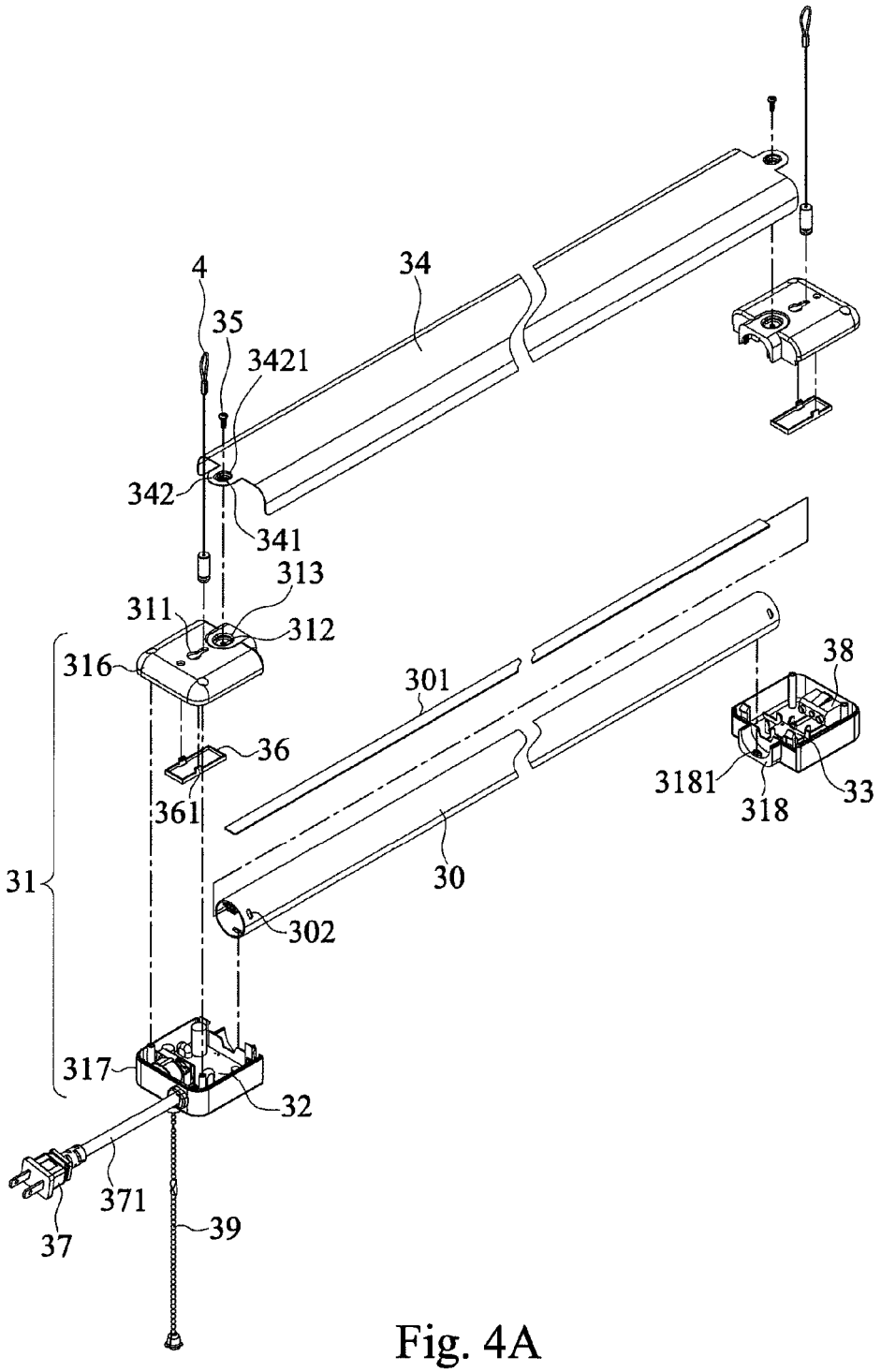
FIG. 4A is a first exploded view of a preferred embodiment of this disclosure.
Figure 4B:
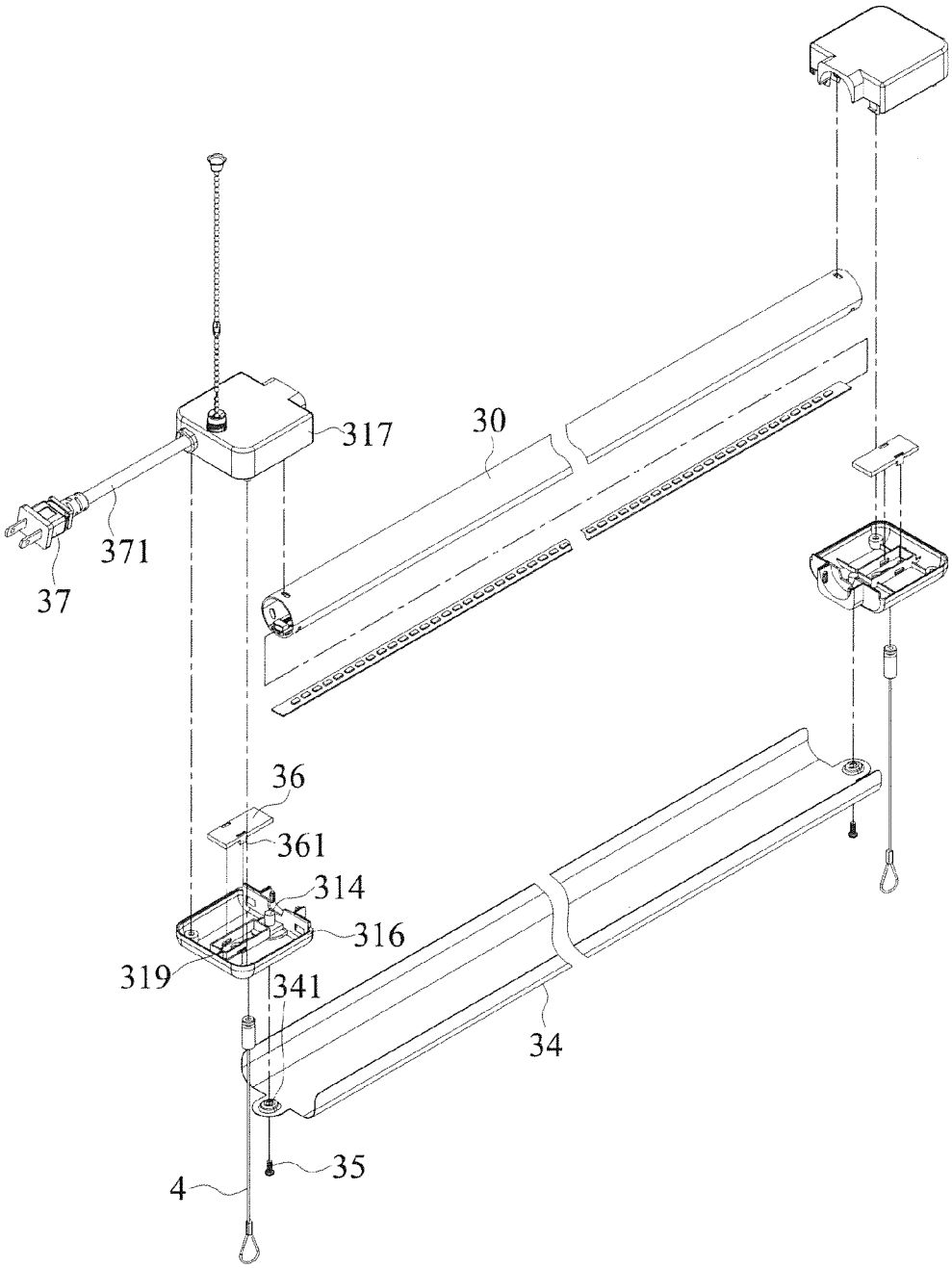
FIG. 4B is a second exploded view of a preferred embodiment of this disclosure.
Figure 5:
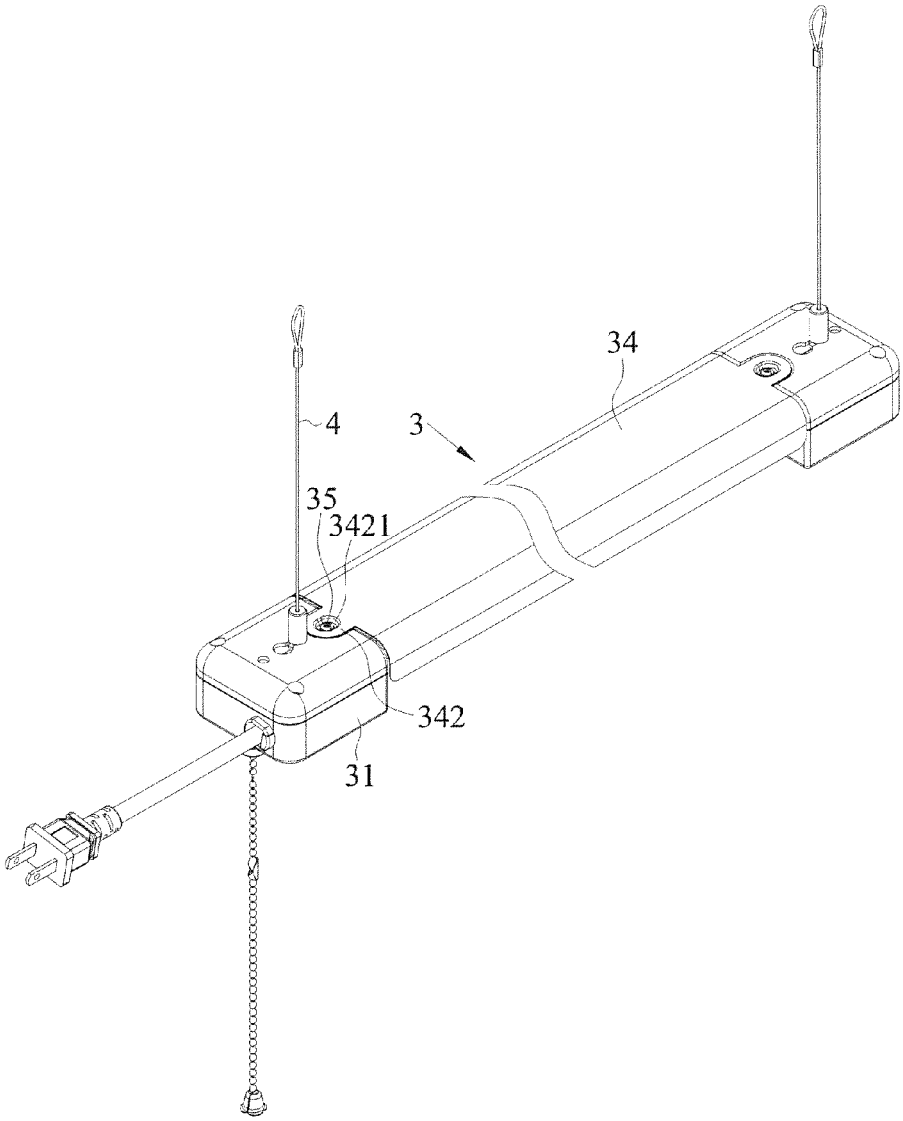
FIG. 5 is a schematic view of an assembly of a preferred embodiment of this disclosure.
Figure 6:
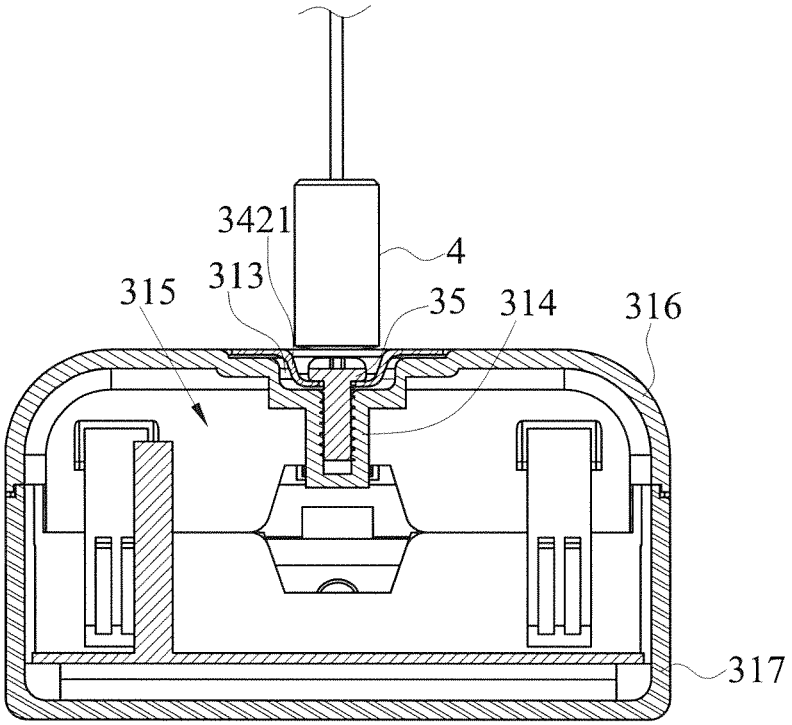
FIG. 6 is a cross-sectional view of a preferred embodiment of this disclosure.

To overcome the problems of the conventional LED lamps, the discloser of this disclosure conducted extensive researches and experiments to improve the protection of the tube of an LED lamp hanged or installed to a ceiling and also maximize the utility of space for installing electronic components, and provided an LED lamp in accordance with an experimental embodiment. With reference to FIGS. 1, 2 and 3 for an exploded view and a schematic view of an experimental embodiment of an LED lamp, and a schematic view of a back plate and an end cover in accordance with the experimental embodiment of this disclosure respectively, the LED lamp 1 comprises a tube 10 and two end covers 11, and the tube 10 includes an LED module 101 installed therein, and the end covers 11 are coupled to both ends of the tube 10 respectively and provided for accommodating a power supply member 12 or a power conversion member 13, and the power supply member 12 and the power conversion member 13 are electrically coupled to the LED module 101 and each of the end covers 11 has a first penetrating hole 111 for engaging a connecting member 2 to hang or install the LED lamp 1.

The LED lamp 1 further comprises a back plate 14, and a plurality of snap holes 141 formed on the back plate 14 and coupled to the end covers 11. Preferably, the back plate 14 is made of metal. Each end cover 11 has a plurality of snap members 112 corresponsive to the snap holes 141 respectively, so that the snap members 112 may be in formed of inverted hooks formed inside the snap holes 141 for connecting the back plate 14 and the end covers 11 as a whole. The end covers 11 are rectangular structures, each having an accommodating space 113, and an isolating plate 15 installed in the accommodating space 113 for preventing the power supply member 12 or the power conversion member 13 from being in contact with the first penetrating holes 111 and the connecting members 2. Preferably, each end cover 11 has an upper casing 114 and a lower casing 115, and the upper casing 114 and the lower casing 115 are engaged with each other to form the end cover 11, so as to facilitate the installation or replacement of the power supply member 12 or the power conversion member 13, and the first penetrating hole 111 is disposed at the upper casing 114 to facilitate the installation or hanging of the LED lamp 1 by using the connecting members 2. Wherein, the first penetrating holes 111 are formed on the upper casing 225, and one of the first penetrating holes 111 is tapered towards a side, and the other first penetrating hole 111 is tapered towards both sides for engaging the connecting member 2, so as to facilitate the installation of the LED lamp by various types of connecting members 2. In addition, each end cover 11 is extended to form a connecting portion 116, and each connecting portion 116 is substantially in a circular shape and has a plurality of ribs 1161 formed on an inner side of the connecting portion 116 and a plurality of second through holes 102 formed on both sides of the connecting portion 116 and corresponsive to the ribs 1161 for latching the ribs 1161 respectively, so as to connect and fix the tube 10 with the end covers 11.

In FIGS. 1 and 2, the snap members 112 may be snapped into the snap holes 141 to form inverted hooks respectively, so that each of the snap members 112 has an L-shaped or J-shaped abutting portion, and after the snap member 112 is passed into the snap hole 141, the snap member 112 is latched for engaging the end covers 11 with the back plate 14. The back plate 14 has the effects of protecting the tube 10, and preventing dust or external force from affecting the use of the LED lamp 1. In the meantime, the LED lamp 1 may come with a one-piece design. In the one-piece lamp, electronic components such as the power supply member 12 and the power conversion member 13 are installed to the LED lamp 1, so that sufficient accommodating space must be reserved, and the rectangular end covers 11 can improve the utility of space for installing the electronic components such as the power supply member 12 and the power conversion member 13, so that different ways of installing the components may be adopted to maximize the utility of space. In addition, most of the connecting members 2 are made of metal to provide better rigidity and load bearing capability for the installed or hanged LED lamp 1. Since the first penetrating holes 111 are formed on the end covers 11 directly, therefore the power supply member 12 or the power conversion member 13 may be in contact with the first penetrating holes 111 and the connecting members 2 easily during the use of the LED lamp 1, and short circuits or fire accidents may occur easily. Therefore, the isolating plates 15 are provided for preventing short circuits or fire accidents.

To fix the isolating plates 15, each end cover 11 has a plurality of first fixing portions 117 on an inner side of the end cover 11, and the isolating plate 15 has a plurality of second fixing portions 151 corresponsive to the first fixing portions 117 respectively for fixing the first fixing portions 117 respectively. Preferably, each of the first fixing portions 117 is a bump or a recess, and each of the second fixing portions 151 is recess or a bump corresponsive to the respective first fixing portion. Preferably, the first fixing portions 117 are disposed on an inner side of the upper casing 114, so that the isolating plate 15 is closer to the upper casing 114 to increase the space for installing components into each end cover 11.

In addition, any one of the end covers 11 has an electric wire 161 and a plug 16, and the plug 16 is electrically coupled to the power supply member 12 through the electric wire 161, and any one of the end covers 11 has a socket 17 electrically coupled to the power conversion member 13. With the plug 16 and the socket 17, the LED lamp 1 may be driven by connecting to an external power supply through the plug 16, or other electronic devices may be connected to the socket 17 for supplying electric power to the other electronic device. Wherein, the LED lamp 1 further comprises a switch 18 installed at one of the end covers 11 and electrically coupled to the power supply member 12. Since the LED lamp 1 has the plug 16, therefore the LED lamp 1 is normally and electrically coupled to the external power supply, and a user may control or turn on/off the LED lamp 1 by the switch 18. Preferably, the switch 18 is a chain switch, so that the user may use the switch 18 to easily control the LED lamp that is hanged or installed to a ceiling.

In FIG. 3, after the snap members 112 are connected to the snap holes 141 of the back plate 14 respectively, the snap members 112 are protruded out from the back plate 141. To take the manufacturing cost, complexity, and safety and smoothness of the operation into consideration, the snap members 112 are integrally formed with the end cover 11 and made of plastic. To consider the overall appearance of the LED lamp 1, the snap members 112 are designed with smaller size and thickness, so that after the back plate 14 and the end covers 11 are assembled, the snap members 112 may be cracked or broken by external force very easily. For example, an inverted hook formed by a portion of the snap member 112 and the snap hole 141 may be broken by external forces easily during transportation, and the back plate 14 and the end covers 11 will be separated. Once the snap member 112 is damaged, the back plate 14 and the end covers 11 cannot be reinstalled. As a result, the yield rate of the LED lamp 1 drops significantly and there is a risk of having an unsecured connection. In addition, it is necessary to apply a force to the snap members 112 to remove the back plate 14 first and then apply a force to the snap members 112 to install another new back plate 14 during the process of replacing the back plate 14, and the snap members 112 may be cracked or broken easily in these cases.

To overcome the aforementioned problem and improve the connection of the back plate 14 and the end covers 11 by inverted hooks, the discloser of this disclosure further provides an LED lamp 1 in accordance with a preferred embodiment of this disclosure. With reference to FIGS. 4A, 4B, 5 and 6 for exploded views, a schematic view and a cross-sectional view of an LED lamp 3 in accordance with a preferred embodiment of this disclosure respectively, the LED lamp 3 comprises a tube 30 and two end covers 31, and the tube 30 includes an LED module 301 installed therein, and the end covers 31 are coupled to both ends of the tube 30 respectively and provided for accommodating a power supply member 32 or a power conversion member 33, and the power supply member 32 and the power conversion member 33 are electrically coupled to the LED module 301. In this preferred embodiment, one of the end covers 31 is provided for accommodating the power supply member 32, and the other end cover 31 is provided for accommodating the power conversion member 33, and electronic components with other functions may be installed in the end cover for controlling the light emission of the LED lamp 3 as needed. Each of the end covers 31 has a first penetrating hole 311 provided for connecting a connecting member 4 to hang or install the LED lamp 3.

The LED lamp 3 is characterized in that it further comprises a back plate 34 having at least two first locking holes 341, and each end cover 31 has at least one second locking hole 312 corresponsive to the respective first locking hole 341. Preferably, the first locking holes 341 are disposed on the opposite sides of the back plate 34, and the back plate 14 is made of metal. By passing at least two latching members 35 through the first locking hole 341 and the second locking hole 312, the back plate 34 and the two end covers 31 are connected to one another, and fixed to a side of the tube 30 by a locking method. Preferably, the latching member 35 is a screw, but this disclosure is not limited to the screw only. The back plate 34 provides the dustproof and shock-resisting effects to the tube 30 and enhances the connection by the locking method, so as to prevent the assembled back plate 34 and end covers 31 from being loosened or separated by the collision with the latching member 35 during the transportation and installation processes.

Wherein, the back plate 34 has at least two engaging portions 342, and each engaging portion 342 is formed by extending from a side of the back plate 34, and the engaging portions 342 are disposed on opposite sides of the back plate 34 respectively, and each engaging portion 342 has a first recess 3421, and the first locking hole 341 is formed in the first recess 3421. Each end cover 31 has a second recess 313 corresponsive to the first recess 3421, and the second locking hole 312 is formed in the second recess 313. When the back plate 34 and the two end covers 31 are assembled, each first recess 3421 and each second recess 313 are superimposed and slightly latched with each other, and the first locking hole 341 and the second locking hole 312 are aligned and communicated with each other, and then the locking members 35 are locked. With the structure of the first recesses 3421 and the second recesses 313, the alignment effect is achieved, and the connection of the back plate 34 and the two end covers 31 is enhanced. When the back plate 34 and the end cover 31 are assembled, it just requires the simple processes of aligning the first recess 3421 with the second recess 313 and locking the back plate 34 and the end cover 31 by the latching member 35. Obviously, this disclosure simplifies the assembling process and provides a convenient way for replacing the components. With the structure of the first recesses 3421 and the second recesses 313, after each latching member 35 is passed through the first locking hole 341 and the second locking hole 312, the latching member 35 is accommodated in the first recess 3421 and disposed at a position lower than the back plate 34 without protruding out from the back plate 34, so as to prevent the back plate 34 and the end covers 31 from being loosened or separated by external forces during transportation.

To fix and protect the latching members 35, an accommodating slot 314 is formed on an inner side of each end cover 31 and configured to be corresponsive to the second recess 313 and the second locking hole 312, so that after the latching member 35 locks the back plate 34 and the end cover 31, the latching member 35 is situated in the accommodating slot 314. After each latching member 35 is passed through each first locking hole 341 and each second locking hole 312 sequentially, the latching member 35 is situated in the corresponding accommodating slot 314, so as to enhance the effect of fixing the locking member 35 into position. During transportation, such arrangement can prevent the latching member 35 from being collided or displaced by external forces and further and avoid the locking member 35 from touching the power supply member 32 or the power conversion member 33 to produce a short circuit.

Each end cover 31 is a rectangular structure and has an accommodating space 315, and an isolating plate 36 installed in the accommodating space 315 and provided for isolating the power supply member 32 or the power conversion member 33, since the first penetrating holes 311 are in contact with the connecting member 4. Since most connecting members 4 are made of metal, and the power supply member 32 and the power conversion member 33 for driving the LED lamp 3 may be in contact with the connecting member 4 through the first penetrating holes 311 easily, therefore there is a risk of having short circuits and/or fire accidents. For the above reason, the isolating plate 36 is installed in each end cover 31 of this preferred embodiment and provided for the isolation effect and prevent the aforementioned risk. In addition, each end cover 31 has an upper casing 316 and a lower casing 317 engaged with each other to form the end cover 31, and such arrangement facilitates the adjustment and installation of the power supply member 32 and the power conversion member 33, and the first penetrating hole 311 is formed at the upper casing 316 to facilitate the installation of the connecting member 4. Wherein, each second recess 313 is formed at each upper casing 316, so that the back plate 34 may be installed at the top side of the LED lamp 3 (in other words, the back plate 34 is installed on a backlit side of the tube 30 proximate to the ceiling). In addition, the first penetrating holes 311 is formed at the upper casing 316, and one of the first penetrating holes 311 is tapered towards a side, and the other first penetrating hole 311 is tapered towards a side or both sides for engaging the connecting member 4, on that the LED lamp 3 may be installed by different methods. In this preferred embodiment, each first penetrating hole 311 is tapered towards the same side and has a circular through penetrating hole area and a slightly elliptical tapered area, so that after the connecting members 4 are installed into the first penetrating holes 311 respectively, the connecting members 4 are moved from the circular area towards the tapered area and snapped into the first penetrating holes 311 respectively. In addition, the way of fixing the tube 30 and the end covers 31 may be the same as that of the experimental embodiment. A connecting portion 318 is formed and extended from each end cover 31, and each connecting portion 318 is substantially in a circular shape and has a plurality of ribs 3181 disposed on an inner side of the connecting portion 318, and the tube 30 has a plurality of second through holes 302 formed on both ends of the tube 30 and corresponsive to the ribs 3181 and latched to the ribs 3181 respectively, so that each end cover 31 may be installed to both sides of the tube 30.

Same as the experimental embodiment, each end cover 31 has a plurality of first fixing portions 319 disposed on an inner side of the end cover 31 for fixing the isolating plates 36, and the isolating plate 36 has a plurality of second fixing portions 361 corresponsive to the first fixing portions 319 and fixed to the first fixing portions 319 respectively. Each of the first fixing portions 319 is a recess or a bump, and each of the second fixing portions 361 is a bump or a recess corresponsive to the respective first fixing portion, so that the isolating plate 36 and the end cover 31 are latched and fixed to each other. To improve the utility of the accommodating space 315, the first fixing portions 319 of this preferred embodiment are disposed on the inner side of the upper casing 316, so that the isolating plate 36 is installed at a position closer to the upper casing 316, but this disclosure is not limited to this embodiment only.

In this preferred embodiment, any one of the end covers 31 has an electric wire 371 and a plug 37, and the plug 37 is electrically coupled to the power supply member 32 through the electric wire 371, and any one of the end covers 31 has a socket 38 electrically coupled to the power conversion member 33. With the same design of the plug 37 and the socket 38 as the experimental embodiment, the LED lamp 3 is normally and electrically coupled to an external power supply through the plug 37, and the socket 38 is provided for connecting several LED lamps 3 in series, and electrically connecting other electronic devices as well, so that the LED lamp 3 may be used for supplying power to other electronic devices. To allow users to control the LED lamp 3 more conveniently, the LED lamp 3 further comprises a switch 39 installed at any one of the end covers 31 and electrically coupled to the power supply member 32. Preferably, the switch 39 is a chain switch provided for users to control and adjust the LED lamp 3.

In summation of the description above, the discloser of this disclosure improves the inconvenience of the conventional one-piece LED lamp by adding the back plate to the LED lamp and adopting the design of the rectangular end cover as illustrated in the experimental embodiment. However, the LED lamp of the experimental embodiment still has the issues of loosening or separating the back plate and breaking the snap member easily by collision in a transportation process after the back plate and the end covers are assembled to the LED lamp. Since the snap member is integrally formed with the end cover, so that the broken snap member cannot be repaired effectively and the yield rate of the product will become very low. To overcome these problems, the discloser of this disclosure based on the idea of the experimental embodiment to develop the LED lamp in accordance with this disclosure while maintaining the advantages of the LED lamp of the experimental embodiment and improve the improper structure with the snap member and the snap hole by using the structure of the first locking holes and the second locking holes together with the locking members instead, so as to overcome the insufficient rigidity and strength of the connected back plate and end covers. The preferred embodiment further adopts the structure with the first recesses, the second recesses and the accommodating slots for locking, so as to further enhance the connection of the back plate and the end covers.

What is claimed is:

1. An LED lamp, comprising a tube and two end covers, and the tube including an LED module therein, and the end covers being coupled to both ends of the tube respectively, and provided for accommodating a power supply member or a power conversion member, and the power supply member and the power conversion member being electrically coupled to the LED module, and the end covers having a first penetrating hole for installing a connecting member to hang or install the LED lamp, and the LED lamp being characterized in that the LED lamp further comprises a back plate, having at least two first locking holes, and each end cover has at least one second locking hole corresponsive to the first locking holes, and at least two latching members pass through the first locking hole and the second locking hole, so that the back plate and the two end covers are coupled to one another and engaged to a side of the tube; each end cover is a rectangular structure having an accommodating space, and the accommodating space has an isolating plate, for isolating the power supply member or the power conversion member, and contacting the connecting member through the first penetrating hole.

2. The LED lamp according to claim 1, wherein the back plate has at least two engaging portions, and each engaging portion is formed by extending outwardly from a side of the back plate and has a first recess, and each first locking hole is disposed in the first recess, and each end cover has a second recess corresponsive to the first recess, and the second locking hole is disposed in the second recess.

3. The LED lamp according to claim 2, wherein each end cover has an accommodating slot formed on an inner side of the end cover and configured to be corresponsive to the second recess and the second locking hole, so that the latching member is disposed in the accommodating slot after locking the back plate and the end cover.

4. The LED lamp according to claim 3, wherein each end cover has an upper casing and a lower casing disposed opposite to each other and assembled to form the end cover, and the second recess and the second locking hole are disposed on the upper casing.

5. The LED lamp according to claim 4, wherein each end cover has a plurality of first fixing portions disposed on an inner side of the end cover, and the isolating plate has a plurality of second fixing portions configured to be corresponsive to the first fixing portions and fixed to the first fixing portions respectively.

6. The LED lamp according to claim 5, wherein each of the first fixing portions is a recess or a bump, and each of the second fixing portions is a bump or a recess corresponsive to the respective first fixing portion.

7. The LED lamp according to claim 1, wherein any one of the end covers has an electric wire and a plug, and the plug is electrically coupled to the power supply member through the electric wire.

8. The LED lamp according to claim 2, wherein any one of the end covers has an electric wire and a plug, and the plug is electrically coupled to the power supply member through the electric wire.

9. The LED lamp according to claim 3, wherein any one of the end covers has an electric wire and a plug, and the plug is electrically coupled to the power supply member through the electric wire.

10. The LED lamp according to claim 4, wherein any one of the end covers has an electric wire and a plug, and the plug is electrically coupled to the power supply member through the electric wire.

11. The LED lamp according to claim 5, wherein any one of the end covers has an electric wire and a plug, and the plug is electrically coupled to the power supply member through the electric wire.

12. The LED lamp according to claim 6, wherein any one of the end covers has an electric wire and a plug, and the plug is electrically coupled to the power supply member through the electric wire.

13. The LED lamp according to claim 7, wherein any one of the end covers has a socket electrically coupled to the power conversion member.

14. The LED lamp according to claim 13, further comprising a switch installed at one of the end covers and electrically coupled to the power supply member.

15. The LED lamp according to claim 4, wherein the first penetrating holes are disposed on the upper casing and one of the first penetrating holes is tapered towards a side, and the other first penetrating hole is tapered towards a side or both sides for coupling the connecting member.

16. The LED lamp according to claim 1, wherein each end cover is extended to form a connecting portion, and each connecting portion is substantially in a circular shape and having a plurality of ribs formed on an inner side of the connecting portion, and a plurality of second through holes formed on both sides of the tube and corresponsive to the ribs and latched with the ribs respectively.

* * * * *